US010748681B2

(12) United States Patent
Poterala

(10) Patent No.: US 10,748,681 B2
(45) Date of Patent: Aug. 18, 2020

(54) VOLTAGE-DEPENDENT RESISTOR DEVICE FOR PROTECTING A PLURALITY OF CONDUCTORS AGAINST A POWER SURGE

(71) Applicant: Hubbell Incorporated, Shelton, CT (US)

(72) Inventor: Stephen Franklin Poterala, Aiken, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/515,337

(22) Filed: Jul. 18, 2019

(65) Prior Publication Data

US 2020/0027630 A1 Jan. 23, 2020

Related U.S. Application Data

(60) Provisional application No. 62/699,897, filed on Jul. 18, 2018.

(51) Int. Cl.
*H01C 7/102* (2006.01)
*H01C 7/12* (2006.01)

(52) U.S. Cl.
CPC ..... *H01C 7/102* (2013.01); *H01C 7/12* (2013.01)

(58) Field of Classification Search
CPC ..... H01C 7/12; H01C 7/102; H01C 7/126; H01C 7/13
See application file for complete search history.

(56) References Cited

U.S. PATENT DOCUMENTS

| | | | | |
|---|---|---|---|---|
| 4,439,807 | A | 3/1984 | Reitz | |
| 5,220,480 | A | 6/1993 | Kershaw, Jr. et al. | |
| 5,324,986 | A * | 6/1994 | Ueno | H01C 7/112 257/701 |
| 6,147,587 | A * | 11/2000 | Hadano | H01C 7/10 338/21 |
| 6,184,769 | B1 * | 2/2001 | Nakamura | H01C 7/112 338/20 |
| 6,608,547 | B1 * | 8/2003 | Greier | H01C 7/105 338/20 |
| 8,947,193 | B2 * | 2/2015 | Rinner | H01C 1/1413 338/22 R |
| 2006/0279172 | A1 * | 12/2006 | Ito | H01C 7/18 310/328 |

OTHER PUBLICATIONS

PCT/US2019/042337 International Search Report and Written Opinion dated Oct. 22, 2019.

* cited by examiner

*Primary Examiner* — Kyung S Lee
(74) *Attorney, Agent, or Firm* — Michael Best & Friedrich, LLP

(57) ABSTRACT

Devices for protecting a plurality of conductors against a power surge. One device includes a first electrode positioned on a first surface of the device, a second electrode positioned on the first surface of the device, and a floating electrode positioned on a second surface of the device. The first electrode is configured to receive a surge current from a first conductor. The surge current travels through the device from the first electrode to the floating electrode and from the floating electrode to the second electrode.

18 Claims, 2 Drawing Sheets

VOLTAGE-DEPENDENT RESISTOR DEVICE FOR PROTECTING A PLURALITY OF CONDUCTORS AGAINST A POWER SURGE

RELATED APPLICATIONS

This application claims the benefit of U.S. Provisional Application No. 62/699,897, filed Jul. 18, 2018, the entire contents of all of which are hereby incorporated by reference.

FIELD

Embodiments described herein relate a voltage-dependent resistor device for protecting multiple conductors against power surges or electrical noise, and more specifically, a voltage-dependent resistor device having more than two electrodes. A voltage-dependent resistor device exhibits a nonlinear relationship between applied voltage and resistive (in-phase) leakage current through the device, and this nonlinearity is important to the function of the device. A metal oxide varistor ("MOV") is one example of a voltage-dependent resistor device that is used in surge arresters.

SUMMARY

Surge protection in both high-voltage circuits and low-voltage circuits may be afforded by surge arresters that utilize one or more voltage-dependent resistor devices. A single MOV acts as a voltage-dependent resistor device. When used to suppress noise, the reactance (capacitance) of the voltage-dependent resistor device is also important, and the device may function as a capacitor with a voltage-dependent leakage current. Multiple voltage-dependent resistor devices in existing surge arresters may be physically separate, or may be manufactured separately and assembled together into a single part. The protective level of a surge arrester is defined as a ratio of voltage during a specified surge event (for example, an 8×20 μs wave at 10,000 A) to a maximum continuous operating voltage ("MCOV") of a device. Secondary surge arresters containing MOVs are generally placed on the low-voltage side of power distribution transformers. The secondary surge arresters may require simultaneous protection of multiple conductors from power surges. However, a standard single MOV may only afford surge protection between one conductor and a reference voltage (for example, ground, neutral, or another phase). Thus, a standard single MOV cannot fully protect systems that utilize more than two conductors.

Prior solutions utilize multiple MOVs within each surge arrester to protect against power surges that may occur on any conductor or on multiple conductors simultaneously. For example, a MOV may be placed between each pair of conductors to limit the relative voltage between those two conductors. For a system with three conductors, complete surge protection between all pairs of conductor may require three MOVs. This case may apply to single-phase systems with three conductors (for example, line, neutral, and ground). In such cases, three MOVs may be used to clamp a line-neutral voltage, a ground-neutral voltage, and a line-ground voltage. Alternatively, a MOV may be placed between each conductor and a ground conductor, such that an absolute maximum voltage of each conductor is limited. Surge protection in this manner may require a number of MOVs equal to the number of conductors in the circuit. This case may apply to three-phase systems with three active conductors (for example, L1, L2, and L3) or split-phase power systems with two active conductors (for example, L1 and L2). In this configuration, the ground conductor for each MOV may be connected with the arrester device. In this configuration, phase-to-phase surge protection may be automatically provided with the maximum phase-to-phase voltage being limited to approximately twice the residual phase-to-ground voltage.

Embodiments described herein relate to providing surge protection to multiple conductors with a single voltage-dependent resistor device. In particular, the voltage-dependent resistor device may include a single monolithic part with more than two active electrodes. The voltage-dependent resistor device described herein reduces a number of parts of an associated surge arrester. Additionally, the volume of active voltage-dependent resistor material may be substantially reduced while offering the same protective level on an individual phase. Therefore, the voltage-dependent resistor device described herein reduces the raw material costs. Accordingly, embodiments described herein provide a voltage-dependent resistor device that protects multiple conductors against power surges. In some embodiments, the voltage-dependent resistor device consists of a single MOV with more than two electrode surfaces.

For example, one embodiment provides a device for protecting a plurality of conductors against a power surge. The device includes a first electrode positioned on a first surface of the device, a second electrode positioned on the first surface of the device, and a floating electrode positioned on a second surface of the device. The first electrode is configured to receive a surge current from a first conductor. The surge current travels through the device from the first electrode to the floating electrode and from the floating electrode to the second electrode Another embodiment provides a surge arrestor for protecting a plurality of conductors against a power surge. The surge arrestor includes a device. The device includes a first electrode positioned on a first surface of the device, a second electrode positioned on the first surface of the device, and a floating electrode positioned on a second surface of the device. The device is configured to receive a surge current from at least one of the plurality of conductors.

Yet another embodiment provides a metal oxide varistor device for protecting a plurality of conductors against a power surge. The device includes a first electrode positioned on a first surface of the device, a second electrode positioned on the first surface of the device, and a floating electrode positioned on a second surface of the device. The device is configured to receive a surge current from at least one of the plurality of conductors.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

As noted above, embodiments described herein provide a voltage-dependent resistor device that protects multiple conductors simultaneously against a power surge. In some applications, the voltage-dependent resistor device may function as a secondary surge arrester on a single-phase circuit with line, neutral, and ground conductors. In other applications, the voltage-dependent resistor device may function as a secondary surge arrester on a three-phase circuit with three conductors. In even other applications, the voltage-dependent resistor device may be used as a noise filter between multiple conductors. The voltage-dependent resistor device includes a single monolithic part with more than two active electrodes. It should be understood that the voltage-dependent resistor device is manufactured as a single entity, and is not a composite of multiple voltage-dependent resistor devices assembled together.

Figure 1A:
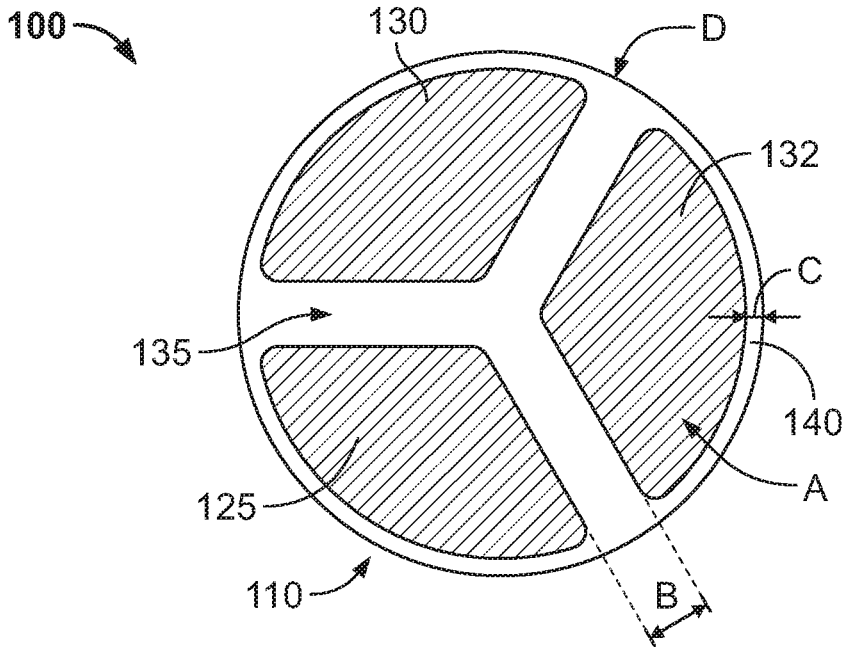
FIG. 1A is a top view of a device for protecting multiple conductors against power surges according to some embodiments.
Figure 1B:
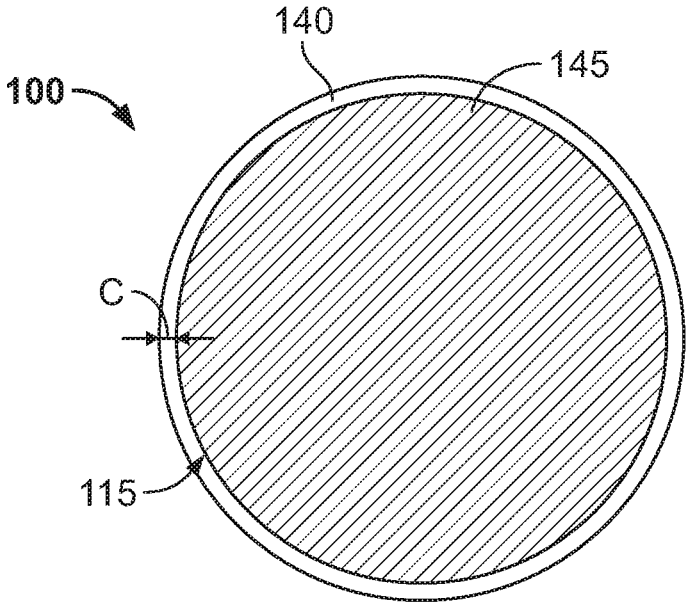
FIG. 1B is a side view of the device of FIG. 1A according to some embodiments.
Figure 1C:
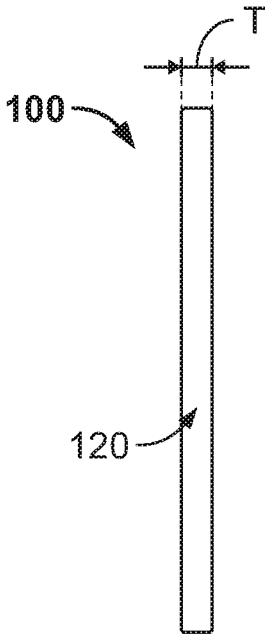
FIG. 1C is a bottom view of the device of FIG. 1A according to some embodiments.

For example, FIGS. 1A-1C illustrate a device 100 for protecting multiple conductors against a power surge according to some embodiments. In some embodiments, the device 100 is a monolithic voltage-dependent resistor device. As mentioned above, the device 100 includes a single monolithic part with a plurality of electrodes. The single monolithic part may be composed of a material showing a strong nonlinear resistive behavior. For example, the single monolithic part may be made of a composition including approximately 75-99% zinc oxide and a variety of dopant elements to provide specific electrical properties. In some embodiments, the single monolithic part is formed of a dense ceramic material. The ceramic material may be made of a composition including approximately 85-95% zinc oxide with a balance consisting of the oxides of manganese, cobalt, nickel, time antimony, bismuth, silver, and boron. Although exemplary compositions of the single monolithic part, including the exemplary ranges of zinc oxide, are disclosed herein, it should be understood that the single monolithic part may be formed of other compositions, including other ranges of zinc oxide, as recognized by those of ordinary skill in the art. Accordingly, in some embodiments, the single monolithic part (e.g., the MOV) is manufactured from a single ceramic pre-form of 75-99% zinc oxide.

As illustrated in FIGS. 1A-1C, the device 100 has a physical shape of a three-dimensional circular disk. In the example illustrated, the device 100 includes a first surface 110 (for example, a top surface) and a second surface 115 (for example, a bottom surface). In some embodiments, as illustrated in FIGS. 1A-1C, the first surface 110 is positioned opposite the second surface 115. The first surface 110 and the second surface 115 may be connected by a third surface 120 (for example, a side surface), as illustrated in FIG. 1C. As illustrated in FIG. 1C, the third surface 120 may have a thickness T.

As noted above, the device 100 includes a plurality of electrodes. Each electrode of the device 100 may be a continuous region that is electrically conductive relative to the single monolithic part of the device 100. In some embodiments, one or more of the plurality of electrodes are applied to a surface of the single monolithic part. For example, each electrode of the device 100 may be an aluminum metal deposited by an arc-spray process to the surface of the device 100 (for example, to the single monolithic part). In other embodiments, one or more of the plurality of electrodes are regions of the single monolithic part having a higher electrical conductivity than the single monolithic part itself.

For example, as illustrated in FIG. 1A, the device 100 includes a first electrode 125, a second electrode 130, and a third electrode 132. The first electrode 125, the second electrode 130, and the third electrode 132 are associated with the first surface 110 of the device 100. As seen in FIG. 1A, an area of the first electrode 125 (for example, a first area), an area of the second electrode 130 (for example, a second area), and an area of the third electrode 132 (for example, a third area) are approximately the same. However, in some embodiments, the area of the first electrode 125, the area of the second electrode 130, and the area of the third electrode 132 are different, as illustrated in FIG. 2B.

The device 100 may include an insulating region 135. The insulating region 135 may be a region of insulating dielectric material that is applied to non-electrode portions of the device 100. As illustrated in FIG. 1A, the insulating region 135 may be associated with the first surface 110 of the device 100. The insulating region 135 may be positioned between the first electrode 125, the second electrode 130, and the third electrode 132. Accordingly, as seen in FIG. 1A, the insulating region 135 separates the first electrode 125, the second electrode 130, and the third electrode 132 from each other. As illustrated in FIG. 1A, the insulating region 135 has a width B. In some embodiments, the width B of the insulating region 135 is at least twice the thickness T of the third surface 120.

The device 100 may include a border region 140. As illustrated in the embodiment of FIG. 1A, the border region 140 is positioned between the plurality of electrodes (for example, the first electrode 125, the second electrode 130, and the third electrode 132) and an edge of the first surface 110. The border region 140 may have a width C. In some embodiments, the width C of the border region 140 is at least half the thickness T of the third surface 120.

FIG. 1C illustrates a bottom view of the device 100 according to some embodiments. As illustrated in FIG. 1B, the device 100 includes a floating electrode 145. The floating electrode 145 may be associated with the second surface 115 of the device 100. As seen in the embodiment of FIGS. 1A and 1C1B, the floating electrode 145 has an area that is different than the areas of the first electrode 125, the second electrode 130, and the third electrode 132. In some embodiments, the floating electrode 145 has no electrical connection. The floating electrode 145 may be used to transport current from one region to another. For example, the floating electrode 145 may transport current from the first electrode 125 to the second electrode 130 or the third electrode 132. Accordingly, the floating electrode 145 places spatially distant areas in electrical series, such as during a power surge. In some embodiments, the floating electrode 145 is placed in contact with a conductive metal disk to reduce the effective resistance between distant points on a surface of the floating electrode 145.

In operation, the first electrode 125, the second electrode 130, and the third electrode 132 are connected to a first conductor, a second conductor, and a third conductor, respectively. The first conductor, the second conductor, and the third conductor may depend on the specific application in which the device 100 is used. For example, when the device 100 is used to protect a single-phase circuit, the first conductor may be a "line conductor," the second conductor may be a "neutral conductor," and the third conductor may be a "ground conductor." In other words, when the device 100 is used to protect a single-phase circuit, the first electrode 125 may be connected to a line conductor, the second electrode 130 may be connected to a neutral conductor, and the third electrode 132 may be connected to a ground conductor. When the device 100 is used to protect a three-phase circuit, the first conductor may be "line 1," the second conductor may be "line 2," and the third conductor may be "line 3." Accordingly, when the device 100 is used to protect a three-phase circuit, the first electrode 125 may be connected to a first conductor carrying AC voltage, the second electrode 130 may be connected to a second conductor carrying AC voltage of approximately the same peak value with a phase shift of about 120 degrees, and the third electrode 132 may be connected to a third conductor carrying AC voltage of approximately the same peak value with a phase shift of about 120 degrees from both the first conductor and the second conductor.

Operation of the device 100 when the device 100 is used to protect a single-phase circuit is described below.

Under normal operation (absent a power surge), the first electrode 125 (connected to a line conductor) may be energized at a nominal line voltage while the second electrode 130 (connected to a neutral conductor) and the third electrode 132 (connected to a ground conductor) are at approximately zero potential. The floating electrode 145 may have a potential that is between approximately one-third and one-half of the potential at the first electrode 125. During normal operation, a small leakage current flows from the first electrode 125 through the device 100 (for example, the single monolithic part) to the floating electrode 145, across the floating electrode 145, and back through the device 100 (the single monolithic part) to the second electrode 130 and the third electrode 132.

When a power surge occurs, a surge current travels to the device 100 through the first conductor, the second conductor, the third conductor, or a combination thereof. As the surge current reaches the associated electrode(s) (for example, the first electrode 125, the second electrode 130, the third electrode 132, or a combination thereof), a resistivity of the device 100 drops to limit an associated surge voltage. The surge current travels from the electrode with the highest potential (for example, the first electrode 125) through the device 100 (the single monolithic part) to the other two electrodes (for example, the second electrode 130 and the third electrode 132). The potential of the floating electrode 145 may be approximately halfway between the highest and lowest potentials of the first electrode 125, the second electrode 130, and the third electrode 132 of the device 100.

The surge current arriving at one or more of the electrodes (for example, the first electrode 125, the second electrode 130, and the third electrode 132) may be dissipated, in varying ratios, to any of the other electrodes. The dissipation of the surge current depends on the potential of the first electrode 125, the second electrode 130, and the third electrode 132 during the power surge. This partitioning occurs automatically such that a maximum voltage between any two conductors is limited by a protective level of the arrester.

Operation of the device 100 when the device 100 is used to protect a three-phase circuit is described below.

During normal operation (absent a power surge), a small leakage current may flow between all three-phases of the three-phase circuit (for example, the first electrode 125, the second electrode 130, and the third electrode 132) and the ground electrode (for example, the floating electrode 145). When a power surge occurs, a surge current travels to the device 100 through the first conductor, the second conductor, the third conductor, or a combination thereof. As the surge current reaches the associated electrode(s) (for example, the first electrode 125, the second electrode 130, the third electrode 132, or a combination thereof), a resistivity of the device 100 (the single monolithic part) drops to limit an associated surge voltage. The surge current may travel through the device 100 between the associated electrode(s) (for example, the first electrode 125, the second electrode 130, the third electrode 132, or a combination thereof) and the floating electrode 145 in either direction depending on a polarity of the surge.

The surge current may be distributed to the floating electrode 145, the first electrode 125, the second electrode 130, the third electrode 132, or a combination thereof such that a maximum voltage between any line and ground may be limited by a protective level of the arrester. The maximum voltage between any two conductors may be automatically limited to twice the voltage between any conductor and the floating electrode 145.

Although the device 100 is described herein as having three electrodes (for example, the first electrode 125, the second electrode 130, and the third electrode 132) associated with the first surface 110 and one electrode (for example, the floating electrode 145) associated with the second surface 115 of the device 100, it should be understood that the device 100 may include additional or fewer electrodes associated with the first surface 110, the second surface 115, or a combination thereof. In other words, the device 100 may be designed with any number of electrodes in order to protect different circuit configurations from a power surge.

Figure 2A:
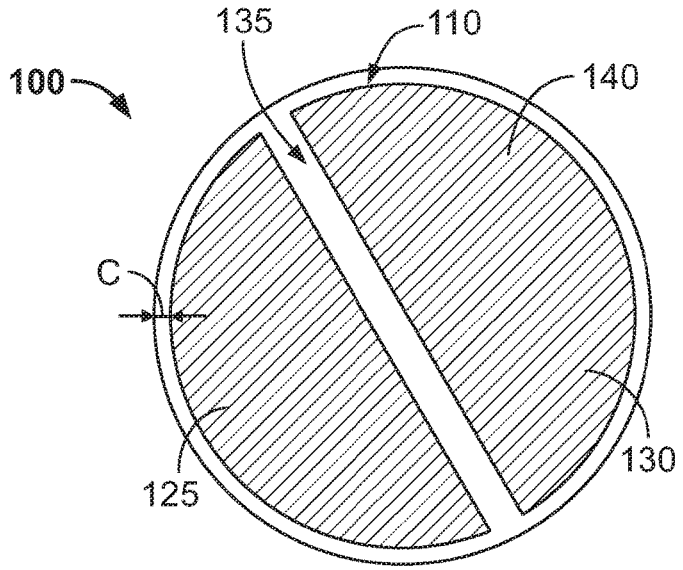
FIG. 2A is a device for protecting multiple conductors against power surges where the device has two electrodes associated with a top surface of the device according to some embodiments.
Figure 2B:
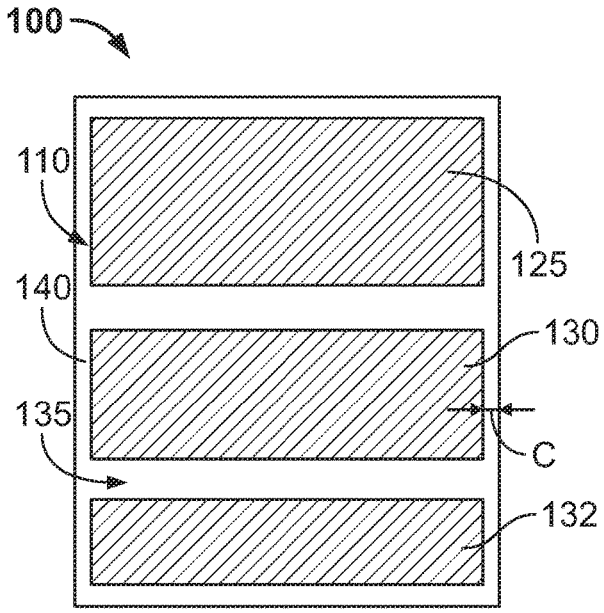
FIG. 2B is a device for protecting multiple conductors against power surges where the device has a rectangular physical shape and three electrodes of varying areas associated with a top surface of the device according to some embodiments.

For example, FIG. 2A illustrates a top view of the device 100 designed to protect single-phase AC equipment operated with two conductors that are 180 degrees out of phase (for example, 240V split-phase power for residential applications). As illustrated in FIG. 2A, the device 100 may include two electrodes, such as the first electrode 125 and the second electrode 130, associated with the first surface 110 of the device 100 and the floating electrode 132 associated with the second surface 115.

Furthermore, the device 100 may have a physical shape different than that illustrated in FIGS. 1A-1C. In some embodiments, the physical shape of the device 100 depends on the intended application of the device 100. The physical shape of the device 100 may include, for example, a rectangle, a square, an oval, a triangle, a cylinder, and the like. For example, FIG. 2B illustrates the device 100 having a rectangular physical shape.

In some embodiments, the device 100 is designed with a physical shape of a cylinder, such as a hollow cylinder. In such embodiments, the device 100 may include a continuous electrode on either an inner diameter or an outer diameter of the cylinder. The device 100 may also include a plurality of electrodes (for example, the first electrode 125, the second electrode 130, and the like) on an opposing surface as the continuous electrode.

In other embodiments, the device 100 is designed as a rectangular plate having a plurality of electrodes (for example, the first electrode 125, the second electrode 130, and the third electrode 132) associated with one surface (for example, the first surface) and a single electrode (for example, the floating electrode 145) associated with another surface (for example, the second surface). When the device 100 is designed as a rectangular plate (as opposed to a circular disk), the device 100 may have a higher volumetric efficiency than, for example, the device 100 illustrated in FIGS. 1A-1C.

Figure 2C:
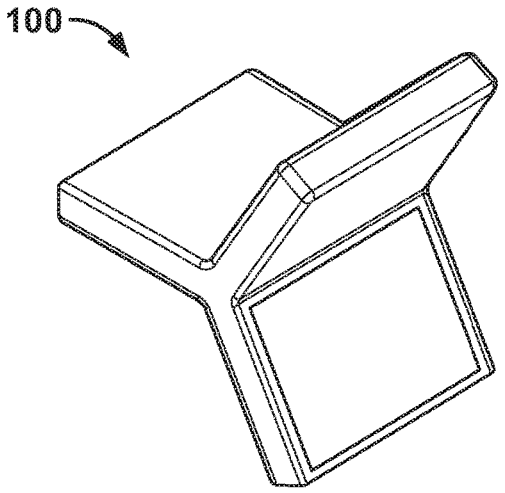
FIG. 2C is a device for protecting multiple conductors against power surges according to some embodiments.

The device 100 may be designed to take on various three-dimensional shapes with various active electrode configurations. For example, FIG. 2C illustrates the device 100 designed to protect a three conductor, single-phase AC circuit. The embodiment illustrated in FIG. 2C may not require a floating ground electrode (for example, the floating electrode 145 of FIG. 1C).

In some embodiments, the areas of the plurality of electrodes (e.g., the first electrode 125, the second electrode 130, and the like) may be different, as noted above. For example, the area of the first electrode 125 may be different from the area of the second electrode 130. In other words, differing levels of protection between various conductors may be provided. Similarly, the thickness T of the device, the width B of the isolating region 135, the width C of the border 140, or a combination thereof may be increased or decreased to provide varying levels of protection.

Thus, the application provides, among other things, a device for protecting a plurality of conductors against a power surge. Various features and advantages of the application are set forth in the following claims.

I claim:

1. A device for protecting a plurality of conductors against a power surge, the device comprising:

a first electrode positioned on a first surface of the device;

a second electrode positioned on the first surface of the device; and a floating electrode positioned on a second surface of the device, wherein the first electrode is configured to receive a surge current from a first conductor, the surge current traveling through the device from the first electrode to the floating electrode and from the floating electrode to the second electrode;

wherein the floating electrode has a potential value that is between a highest potential value and a lowest potential value of the first electrode and the second electrode.

2. The device of claim 1, further comprising:

a border region positioned on the first surface of the device; and an isolating region positioned on the first surface of the device, the isolating region separating the first electrode and the second electrode.

3. The device of claim 1, wherein the device is a metal oxide varistor element included within a surge arrester.

4. The device of claim 1, wherein the first electrode is associated with a first conductor and the second electrode is associated with a second conductor different from the first conductor.

5. The device of claim 1, wherein a physical shape of the device is at least one selected from a group consisting of a circular disk, a cylinder, a rectangle, a square, an oval, and a triangle.

6. The device of claim 1, wherein an area of the first electrode is the same as an area of the second electrode.

7. The device of claim 1, wherein an area of the first electrode is different than an area of the second electrode.

8. The device of claim 1, further comprising a third electrode positioned on the first surface of the device.

9. The device of claim 1, wherein a resistivity of the device decreases when the first electrode receives the surge current.

10. A surge arrestor for protecting a plurality of conductors against a power surge, the surge arrestor comprising:

a device, the device including a first electrode positioned on a first surface of the device;

a second electrode positioned on the first surface of the device; and a floating electrode positioned on a second surface of the device, wherein the device is configured to receive a surge current from at least one of the plurality of conductors;

wherein a resistivity of the device decreases when the first electrode receives the surge current.

11. The surge arrestor of claim 10, wherein the device is configured to receive the surge current at at least one selected from a group consisting of the first electrode and the second electrode.

12. The surge arrestor of claim 10, wherein the first electrode is configured to receive a surge current from a first conductor and the second electrode is configured to receive a surge current from a second conductor.

13. A metal oxide varistor device for protecting a plurality of conductors against a power surge, the device comprising:

a first electrode positioned on a first surface of the device;

a second electrode positioned on the first surface of the device; and a floating electrode positioned on a second surface of the device, wherein the device is configured to receive a surge current from at least one of the plurality of conductors; and a third electrode positioned on the second surface of the device.

14. The device of claim 13, wherein the device is configured to receive the surge current at at least one selected from a group consisting of the first electrode and the second electrode.

15. The device of claim 13, wherein the first electrode is configured to receive a surge current from a first conductor and the second electrode is configured to receive a surge current from a second conductor.

16. The device of claim 13, wherein the first electrode is connected to a first conductor included in the plurality of conductors and the second electrode is connected to a second conductor included in the plurality of conductors.

17. The device of claim 13, wherein the device is manufactured from a single ceramic pre-form of 75-99% zinc oxide.

18. The device of claim 13, wherein the first electrode is connected to a first conductor included in the plurality of conductors and the third electrode is connected to a second conductor included in the plurality of conductors.

* * * * *